United States Patent [19]

Pittman et al.

[11] Patent Number: 4,498,845

[45] Date of Patent: Feb. 12, 1985

[54] PUMPER BUMPER

[76] Inventors: Homer F. Pittman, 3414 Clearmont, Odessa, Tex. 79762; Bobby D. Gage, 1410 W. 22nd St., Odessa, Tex. 79760

[21] Appl. No.: 503,711

[22] Filed: Jun. 13, 1983

[51] Int. Cl.[3] ..... F04B 39/00

[52] U.S. Cl. ..... 417/545; 92/13.1; 74/41; 74/586

[58] Field of Search ..... 417/53, 430, 545, 554, 417/313, 321; 92/13, 13.1; 74/41, 586; 254/106, 107; 73/862.54

[56] References Cited

U.S. PATENT DOCUMENTS

| | | | |
|---|---|---|---|
| 2,351,576 | 6/1944 | Thigpen | 417/313 |
| 2,741,915 | 4/1956 | Renken et al. | 73/862.54 |
| 2,877,652 | 3/1959 | Muschalek | 74/41 |
| 3,089,428 | 5/1963 | Johnston | 417/313 |
| 3,160,111 | 12/1964 | Berry | 417/321 X |
| 3,203,669 | 8/1965 | Johansson | 254/107 |
| 3,251,310 | 5/1966 | Wittwer et al. | 417/53 |
| 3,355,938 | 12/1967 | Neely et al. | 73/862.54 |
| 3,499,324 | 3/1970 | Wenisch | 73/862.54 |
| 4,187,765 | 2/1980 | Mattoon | 92/13.1 |
| 4,286,656 | 9/1981 | Felder | 74/586 X |
| 4,296,678 | 10/1981 | Felder | 92/13.1 |
| 4,354,395 | 10/1982 | Page, Jr. | 74/583 X |

*Primary Examiner*—William L. Freeh

*Assistant Examiner*—Paul F. Neils

*Attorney, Agent, or Firm*—Marcus L. Bates

[57] ABSTRACT

Method and apparatus by which a malfunctioning downhole pump of the reciprocatory type can be rendered operative by bumping the pump piston against structure associated with the pump barrel. The invention is carried out on a reciprocatory downhole pump of the type which is actuated by a rod string. The rod string is reciprocated by a pumpjack unit. A hydraulic jack apparatus is interposed between the hanger bar and polish rod clamp of the pumpjack bridle assembly so that the hydraulic jack can be extended to enable spacers to be removed or inserted at a location which changes the relative position of the polish rod clamp and hanger bar, and which also changes the relative position of the downhole pump piston and pump barrel. This action enables the pump piston to bump or impact against the pump barrel, thereby imparting a jarring movement into the traveling and fixed pump valves, so that debris which may have accumulated between either of the seats and valve elements of the pump can be dislodged; or, in the instance of gas lock, compressible fluid is forced from the pump, uphole to the surface by the jarring or bumping action. The present method easily enables the downhole pump to be made operative without the necessity of withdrawing the sucker rod string or the tubing string from the borehole.

6 Claims, 6 Drawing Figures

PUMPER BUMPER

BACKGROUND OF THE INVENTION

Most hydrocarbon producing wells employ a downhole pump which is reciprocated by a rod string. The rod string is actuated by a pumpjack unit. The downhole pump includes a piston, or a plunger, within which a traveling valve is incorporated. The piston reciprocates within a pump barrel, and a standing, or fixed valve is placed below the pump barrel. As the sucker rod string reciprocates the pump piston, fluid is lifted to the surface of the earth.

From time to time debris will accumulate under either the traveling or fixed valve, thereby preventing the valve element from properly seating, and consequently, the pumping action will be greatly reduced and in many instances, the pumping action will altogether cease. This same malfunction occurs whenever compressible fluid accumulates between the valves of the pump assembly, and causes a condition referred to as fluid pounding, or gas lock, to arise.

In the past, those skilled in the art of producing oil wells with pumpjack units have discovered that the stuck pump valves sometime can be jarred loose, or that the valves can be jarred to pass the gas through the pump. This is accomplished by de-energizing the pumpjack unit, after which the rod clamp is repositioned on the polish rod at a particular location which enables the downhole pump piston to strike or impact against the pump barrel. This adjustment is critical, and a considerable amount of time and expertise is required in order to properly bump the piston against the barrel without injuring the downhole equipment.

After the downhole pump has been bumped in the above described manner, the rod clamp is returned to its original position respective to the polish rod, and the well pumpjack unit is again energized. In the event the debris has not been dislodged from the valve assemblies, it is necessary to repeat the entire operation. The same holds true for the gas lock condition. This procedure must therefore be carried out until the well is again satisfactorily producing the downhole fluid.

Usually four men are required to work the better part of an hour in order to bump a well. One procedure used in the past is to place a second polish rod clamp on the polished rod, and manipulate the walking beam in a manner to enable the first clamp to be moved up the polish rod until the string is spaced out an appropriate amount to achieve the desired impact from the resultant bumping action. The pumpjack unit is then energized so that the downhole pump is bumped for awhile, and thereafter the polish rod clamp must be returned to its original position by reversing the above procedure. Needless to say, many a workman's hand has inadvertently been caught under a clamp and severely injured. Furthermore, four workmen manipulating a pumpjack unit creates various different unsafe conditions wherein numerous other occasions for possible injury arises.

In some instances, the technicians will repeat the procedures many times, and eventually, if the well pump fails to satisfactorily respond to the bumping treatment, it is necessary to pull the rod string and investigate the condition of the traveling valve. If the trouble lies with the standing valve, it is necessary to pull the production string and pump barrel, and clean the debris from the standing valve. This is a very expensive procedure and sometimes requires an expenditure of several thousand dollars.

It would therefore be desirable to be able to precisely control the relative position of the pump piston and pump barrel so that the well can be bumped under closely controlled conditions, and thereafter be placed back into operation safely with a minimum amount of labor and abuse to the downhole equipment.

Method and apparatus which achieve the above desirable goal is the subject of the present invention.

THE PRIOR ART

Neely et al., U.S. Pat. No. 3,355,938 teaches a jack device and spacer means interposed between a hanger bar and stop element of a pumpjack unit. The jack means is moved towards the hanger bar to bring a strain gauge into operation whereby stress on the stop element is transferred to the strain gauge in order to measure the load imposed on the sucker rod string. After the strain gauge reading has been taken, the jacking machines are again energized so that a spacer plate can be removed. The jacking means is then actuated to enable the polish rod load to be placed back onto the spacer sleeve.

Fiedler et al., U.S. Pat. No. 4,022,430 discloses a sucker rod adjustment tool which enables the relative position of a sucker rod to be adjusted by the provision of hydraulic servos which retract a lifting collar. When the collar is lifted, a clamp moves the rod up through the supporting member. The rod clamp is then loosened and slid down the sucker rod until it is in contact with a supporting member. Hydraulic pressure is then released from the servos so that the weight of the sucker rod is transferred from the clamp into a member. After the desired adjustment has been made, the rod clamp is adjusted, hydraulic pressure is released from the servos, and the weight of the sucker rod causes the rod clamp to contact the supporting member. The weight is then relieved on the rod clamp which can now be removed or repositioned if additional adjustment is required.

Various mechanisms are known to those skilled in the art which hydraulically lift elongated members; as for example, Ahl U.S. Pat. Nos. 3,901,477 and 3,325,146; Johansson U.S. Pat. No. 3,203,669; Brown U.S. Pat. No. 3,096,075; Gattner et al U.S. Pat. No. 3,085,787; and Bentley et al. U.S. Pat. No. 2,830.788. However, none of these apparatus are for use in conjunction with a pumpjack unit and sucker rod string, and therefore these references fail to disclose Applicants' claimed invention.

SUMMARY OF THE INVENTION

The present invention comprehends both method and apparatus for obviating a gas lock condition in a downhole pump as well as eliminating debris from proximity of the valve system contained within a reciprocating downhole pump assembly. The downhole pump associated with this invention is of the type which is actuated by a rod string, and the rod string preferably is reciprocated by a pumpjack unit.

The apparatus by which the present invention is carried out comprises a hydraulically actuated jack means having a piston and cylinder assembly. The jack means is placed between the hanger bar and rod clamp associated with a bridle assembly of a pumpjack unit. The relative relationship of the polish rod and the horsehead also determines the relative relationship between the downhole pump piston and pump barrel. Accordingly, as the hydraulic piston is forced to stroke out of the hydraulic cylinder of the jack means, the distance measured between the hanger bar and the rod clamp increases. This action also moves the pump piston of the downhole pump uowardly respective to the downhole pump barrel.

A plurality of spacers in the form of a shim pack is interposed between the main body of the jack means and the hanger bar of the bridle assembly. The shim pack and jack means remain installed on the pumpjack bridle during normal operation of the pumpjack unit. At any subsequent time, the hydraulic piston and cylinder means are actuated to move the rod clamp vertically upward respective to the hanger bar. This action enables one or more spacers of the shim pack to be removed. The pressure effected on the hydraulically actuated jack means is then reduced sufficiently to allow the rod clamp to move downwardly towards the hanger bar an amount which causes the downhole pump piston to impact against the downhole pump barrel.

The pumpjack unit is energized, thereby reciprocating the polish rod, and causing the downhole pump to be reciprocated by the rod string. The rod string, by the foregoing adjustment, has been repositioned sufficiently to cause the pump piston to impact against structure associated with the pump barrel, without the necessity of relocating the polish rod clamp. The resultant shock of the piston being arrested as it engagingly impacts against the pump barrel jars the valve assemblies associated with the downhole pump sufficiently to loosen debris which may have been captured between the downhole pump valve element and seat.

During the bumping operation, the hydraulically actuated piston and cylinder assembly can be actuated in either direction so as to increase or decrease the magnitude of the impact energy, as may be desired. When it is determined that the jarring action has caused the debris to have been removed from the valve assemblies, the pumpjack unit is de-energized, the hydraulically actuated piston and cylinder assembly is stroked apart, the spacers of the shim pack replaced, and the production is resumed. This same procedure is employed in order to eliminate gas lock in the downhole pump.

The present invention enables the severity of the bumping action to be directly controlled by a single operator. The shim pack enables the optimum adjustment to be rapidly and accurately returned to the apparatus. The hydraulically actuated piston and cylinder assembly can be left attached to the pumpjack bridle. A quick disconnect supply hose leading to a suitable hydraulic pressure source can be employed for fluid pressure, thereby enabling the pump assembly to be rapidly and easily serviced by one oilfield technician.

Accordingly, a primary object of the present invention is the provision of method and apparatus by which a downhole pump assembly associated with a pumpjack can be bumped in order to dislodge debris which may be captured between the valve seat and valve element of the traveling and standing valve assemblies, or to pass gas through the valve assemblies.

Another object of the present invention is the provision of a hydraulically actuated jack means interposed between the rod clamp and hanger bar of the bridle assembly of a pumpjack means for adjusting the relative position of the pump barrel and pump piston so that when the pump piston is actuated by the sucker rod string, the pump piston impacts against structure associated with the pump barrel.

A further object of this invention is the provision of a method of dislodging debris and gas from the standing and traveling valve assemblies of a downhole pump by changing the relative position of the rod string from above the ground to thereby change the relative position between the pump piston and pump barrel.

A still further object of this invention is the provision of a method of passing gas through a downhole pump or for dislodging debris which may be captured between the standing and traveling valve assemblies of a downhole pump by moving the polish rod vertically respective to the bridle of a pumpjack unit so that the downhole pump piston impacts against structure associated with the downhole pump barrel.

Another and still further object of the present invention is the provision of a method and apparatus by which the relative position of a pump barrel and pump piston is selectively and controllably changed from above the ground so that the piston impacts against structure associated with the pump barrel and thereby contacts and shocks the downhole pump sufficiently to cause debris to be dislodged from the standing and traveling valve assemblies or accumulated gas to be translocated to the surface.

These and other objects are attained in accordance with the present invention by the provision of a combination of elements which are fabricated in a manner substantially as described in the above abstract and summary.

These and various other objects and advantages of the invention will become readily apparent to those skilled in the art upon reading and following detailed description and claims and by referring to the accompanying drawings.

DETAILED DESCRIPTION OF THE PREFERRED EMBODIMENT

Figure 1:
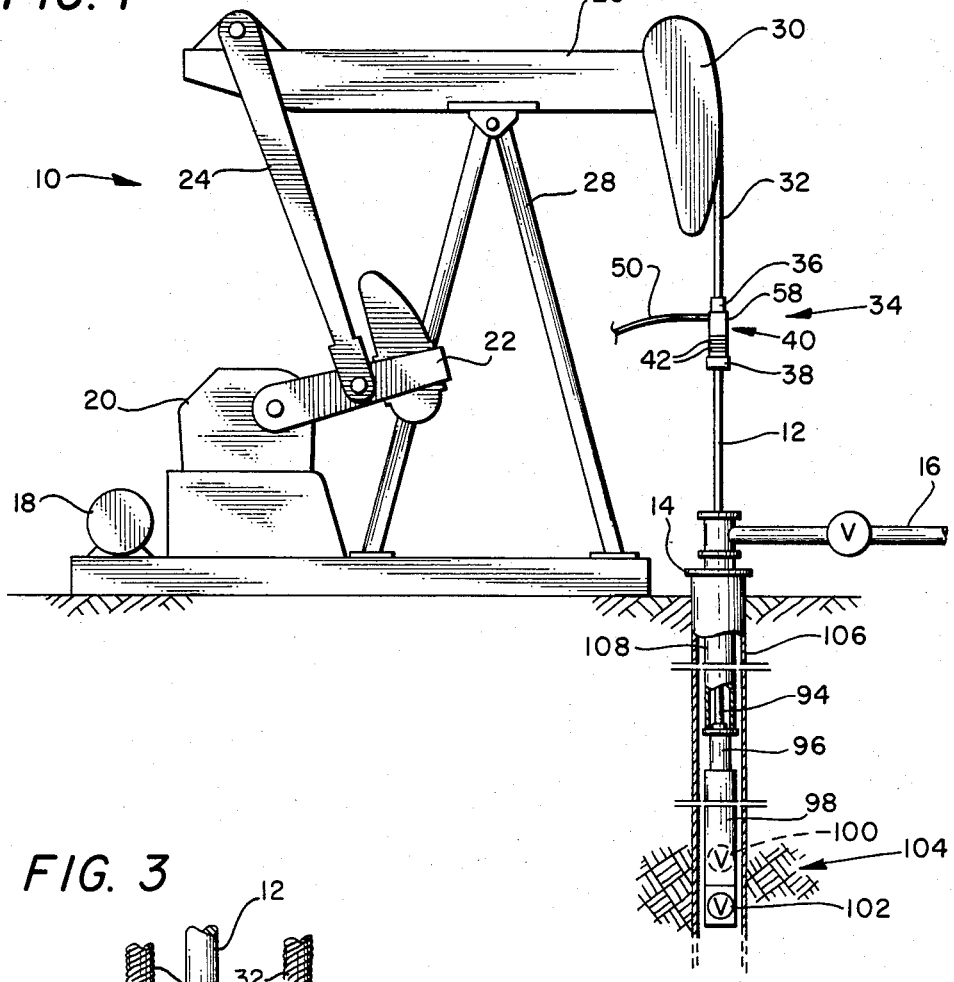
FIG. 1 is a part diagrammatical, part schematical, side elevational view of a pumpjack unit and downhole pump assembly illustrated in conjunction with a borehole.

FIG. 1 discloses an oil well having a pumpjack unit of conventional design associated therewith, as generally indicated by the arrow at numeral 10. The apparatus of FIG. 1 includes a polish rod 12 which forms part of a rod string. The rod string extends down through the upper end 14 of a wellbore. The upper terminal end of the wellbore includes the usual stuffing box at an out flow line 16.

A motor 18 drives a gear box 20 which in turn rotates a crank 22. The crank 22 is connected to actuate the pitman arm 24. The pitman arm rocks a walking beam 26 which is journaled to a Sampson post 28. One end of the walking beam is provided with a horsehead 30.

Bridle 32 is connected to the horsehead in a conventional manner, and to the before mentioned polish rod 12 by apparatus 34, made in accordance with the present invention.

Figure 3:
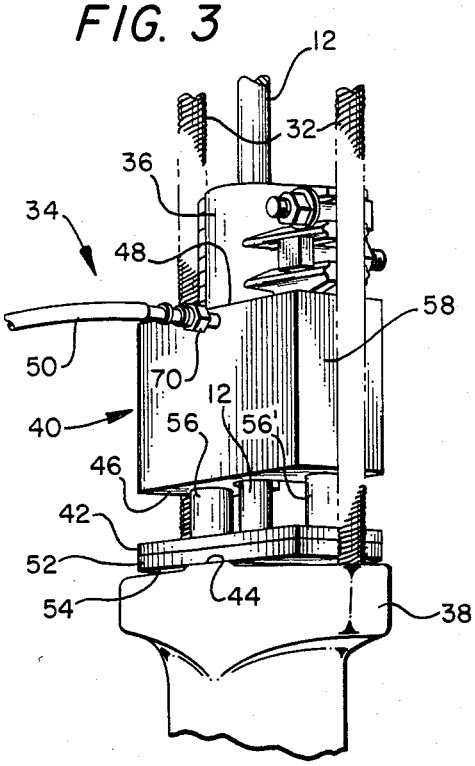
FIG. 3 illustrates the apparatus of FIG. 2 in an alternate position of operation.
Figure 2:
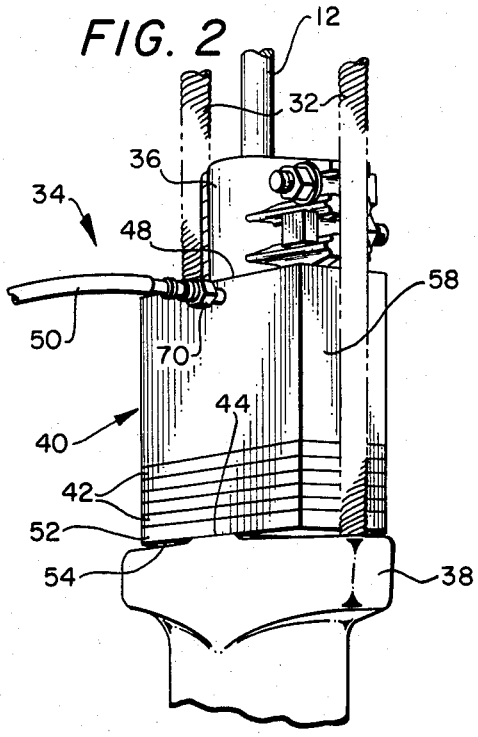
FIG. 2 is a fragmentary, enlarged, perspective view of part of the apparatus disclosed in FIG. 1.

Apparatus 34 is more specifically set forth in FIGS. 2–5. FIGS. 2 and 3 disclose a rod clamp 36 spaced from a hanger bar 38 by means of a hydraulic jack device 40 and a shim pack 42. Numeral 44 indicates the upper flat surface of the hanger bar while numeral 46 indicates the bottom or lower flat surface of the hydraulic jack device 40. The top surface 48 of the jack device is relatively flat and receives the clamp 36 in abutting engagement thereagainst. As seen in FIGS. 2 and 3, a hydraulic pressure hose 50 is connected to the jack device and to a suitable source of hydraulic pressure.

Figure 5:
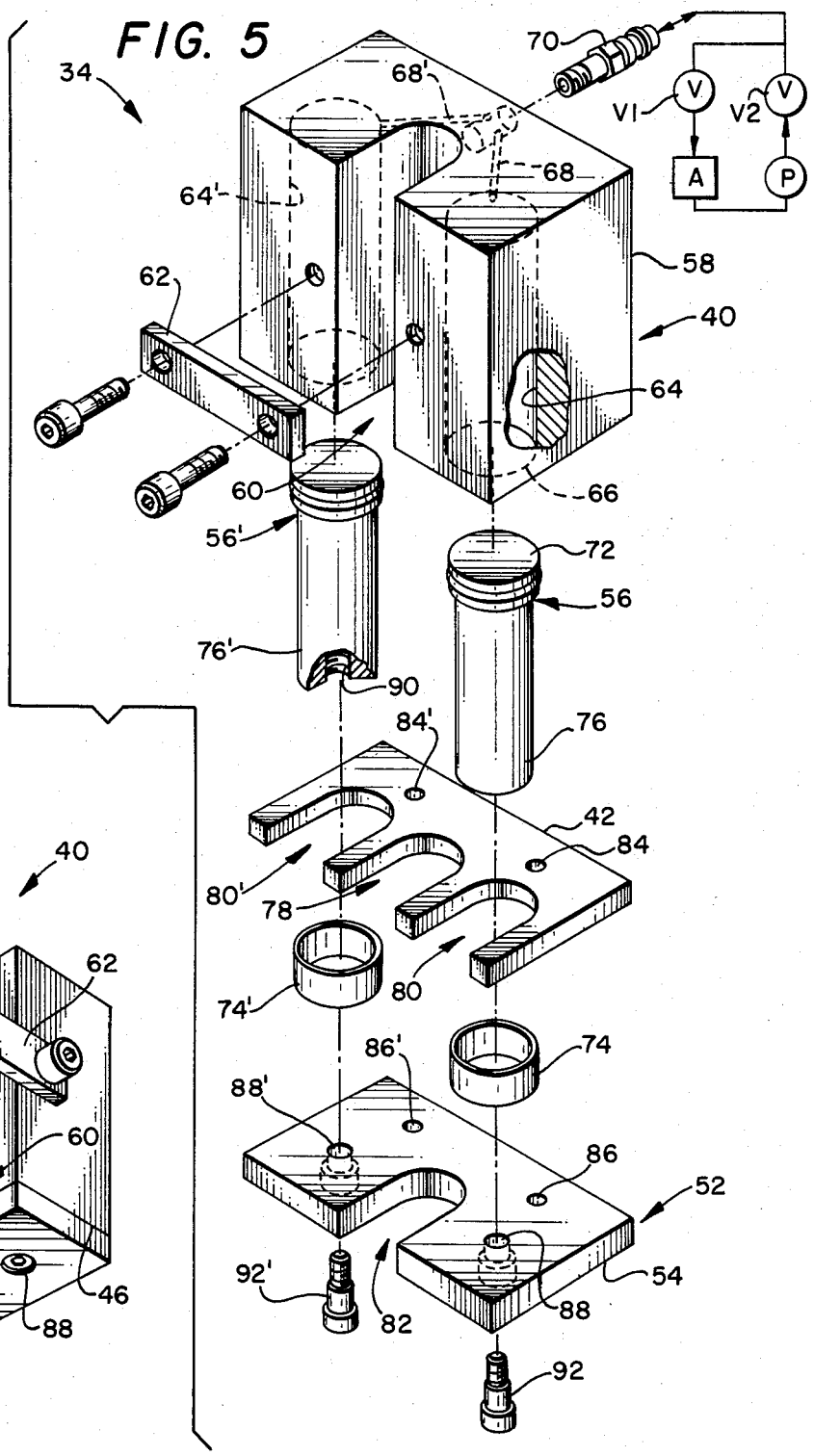
FIG. 5 is an enlarged, exploded view illustrating further details of the apparatus seen disclosed in FIGS. 2 and 3; and, FIG. 6 is a partially disassembled, perspective view of an alternate embodiment of the apparatus disclosed in FIGS. 2 and 5.

Numeral 52 of FIGS. 2–5 indicates the jack base plate having a lower face 54 which abuttingly engages the upper surface 44 of the before mentioned hanger bar 38. The base plate is connected to the outer face of a pair of pistons 56, 56′ as illustrated in FIGS. 3 and 5.

Figure 4:
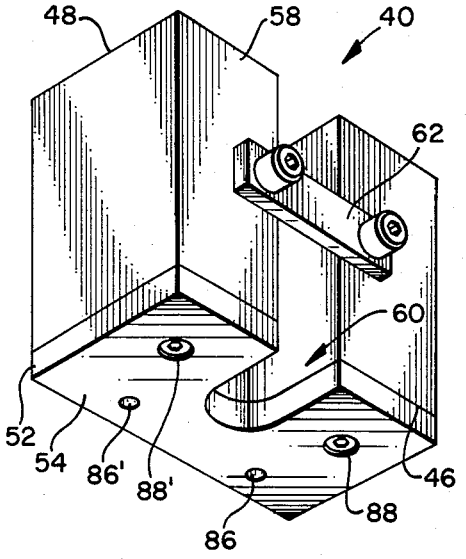
FIG. 4 is a perspective view of the opposite side of the apparatus disclosed in FIGS. 2 and 3.

In FIGS. 3–5, the jack means or jack apparatus of the present invention is seen to include a main body 58 having a longitudinally extending rod valley or trough 60 which outwardly opens to thereby enable a medial length of the polish rod 12 to be freely received therewithin. A removable keeper 62 loosely captures the rod 12 within the rod valley.

As best illustrated in FIG. 5, the main body of the jack means includes counterbores 64 and 64′ which form hydraulic cylinders. The cylinders are aligned parallel respective to one another and to the rod trough 60, with the trough and cylinders being spaced from one another. The cylinders downwardly open at the lower face 46 of the main body of the jack means, with the before mentioned pistons 56, 56′ being reciprocatingly received in close tolerance relationship within the cylinders 64, 64′. Passageways 68, 68′ are connected to the upper extremity of the cylinders 64 and 64′ and jointly communicate with a quick disconnect fitting 70. The quick disconnect fitting 70 forms a flow passageway through which hydraulic fluid can flow from the pump P, or towards the accumulator A, depending upon the position of the schematically illustrated valves V1 and V2 of FIG. 5.

The pistons 56, 56′ include a piston head 72 in the form of an enlarged boss. The boss includes seal means for withstanding great pressure differential thereacross. Piston guides 74 and 74′ are in the form of an annulus having an outside diameter which admits the guide into the lower end of each cylinder 64 and 64′ and further includes an inside diameter which reciprocatingly receives the lower marginal end 76, 76′ of the piston therethrough in close tolerance relationship therewith.

The before mentioned shim pack 42 includes a plurality of stacked spacer members, each being superimposed in aligned relationship upon one another. Each of the shims of the pack 42 include an outwardly opening trough 78 which is aligned with the before mentioned trough 60 of the main body 58. Outwardly opening troughs 80, 80′ are spaced from one another by the trough 78. The troughs 80, 80′ permit the small outside diameter of piston 56 to freely extend therethrough.

The shim pack or spacer 42 further includes bolt holes 84, 84′ which are aligned with one another and with index bolt holes 86, 86′ of base plate 52. Bolt holes 88, 88′ are formed through the base plate 52 and are aligned with the threaded cavity 90 formed into the lower end portion of each of the pistons 56, to thereby enable bolts 92, 92′ to removably affix base plate 52 to the lower face of pistons 56 and 56′.

Looking again now to FIG. 1, it will be noted that the illustrated producing oil well includes a downhole pump assembly of conventional design. The pump assembly includes a pump piston schematically indicated by the numeral 96. The pump piston reciprocates within a pump barrel 98. The pump piston includes a traveling valve assembly 100, while a standing valve assembly 102 is affixed to the pump barrel in underlying relationship therewith. The valves usually include an annular seat against which a ball sealingly rests when the valve is in the closed position, and which is displaced from the seat when the valve is in the opened position.

The valves cooperate with one another to permit downhole fluids to flow from payzone 104, through perforations formed within a casing 106, through the lower standing valve 102, through the traveling valve 100 where the fluid is lifted up through a tubing string 108 and then flows through outflow or gathering pipe 16.

In operation, the apparatus 34 of the present invention reciprocates with and forms a part of the bridle and rod assembly. The apparatus 34 transfers the weight of the polished rod 12 into the bridle 32 at hanger bar 38. Occasionally debris become lodged between the seat and ball of either the traveling or standing valve assemblies of the downhole pump. When this occurs, production at 16 is greatly diminished. The debris can simultaneously be removed from either or both of the valve assemblies by bumping the downhole pump piston against structure associated with the downhole pump cylinder. That is, when the pump piston is lowered, it ultimately strikes a structure associated with the downhole pump assembly. Pressure is applied to the hose 50, thereby moving the lower face 46 of the main body 58 vertically upward respective to the base plate 52 of the hydraulically actuated pistons, thereby changing the apparatus 34 from the illustrated configuration of FIG. 2 into the illustrated configuration of FIG. 3. One or more of the spacers can now be removed from the shim pack 42 so that the resultant configuration of apparatus 34 assumes the condition seen in FIG. 3. Pressure is now released from hydraulic hose 50, causing the lower face 46 of main body 58 to bear against the upper face of plate member 52, or against the upper face of the uppermost spacer left within the shim pack.

Further reciprocation of the polish rod now causes the downhole pump piston to bump against the pump barrel. This bumping action jars the traveling and standing valve assemblies, while at the same time production fluid is forced to flow through the inoperative valve and seat. The impact imposed upon the valve and seat by the bumping action, together with the fluid flow occasioned by the stroking of the downhole pump piston, loosens any interfering debris and causes the debris to be flowed from the downhole pump and out of the production string.

As soon as the malfunction of the valve system has been corrected, the production rate will increase to the normal amount of flow. At this time, hydraulic pressure is again applied to the jack pistons, thereby moving the main body and base plate 52 back into the illustrated position of FIG. 3. The previously removed spacers of the shim pack are replaced into the intervening area provided by the stroked hydraulic jack, the hydraulic pressure is removed from the hose 50, the hose is removed from the fitting 70, and the apparatus 10 resumes normal production.

Figure 6:
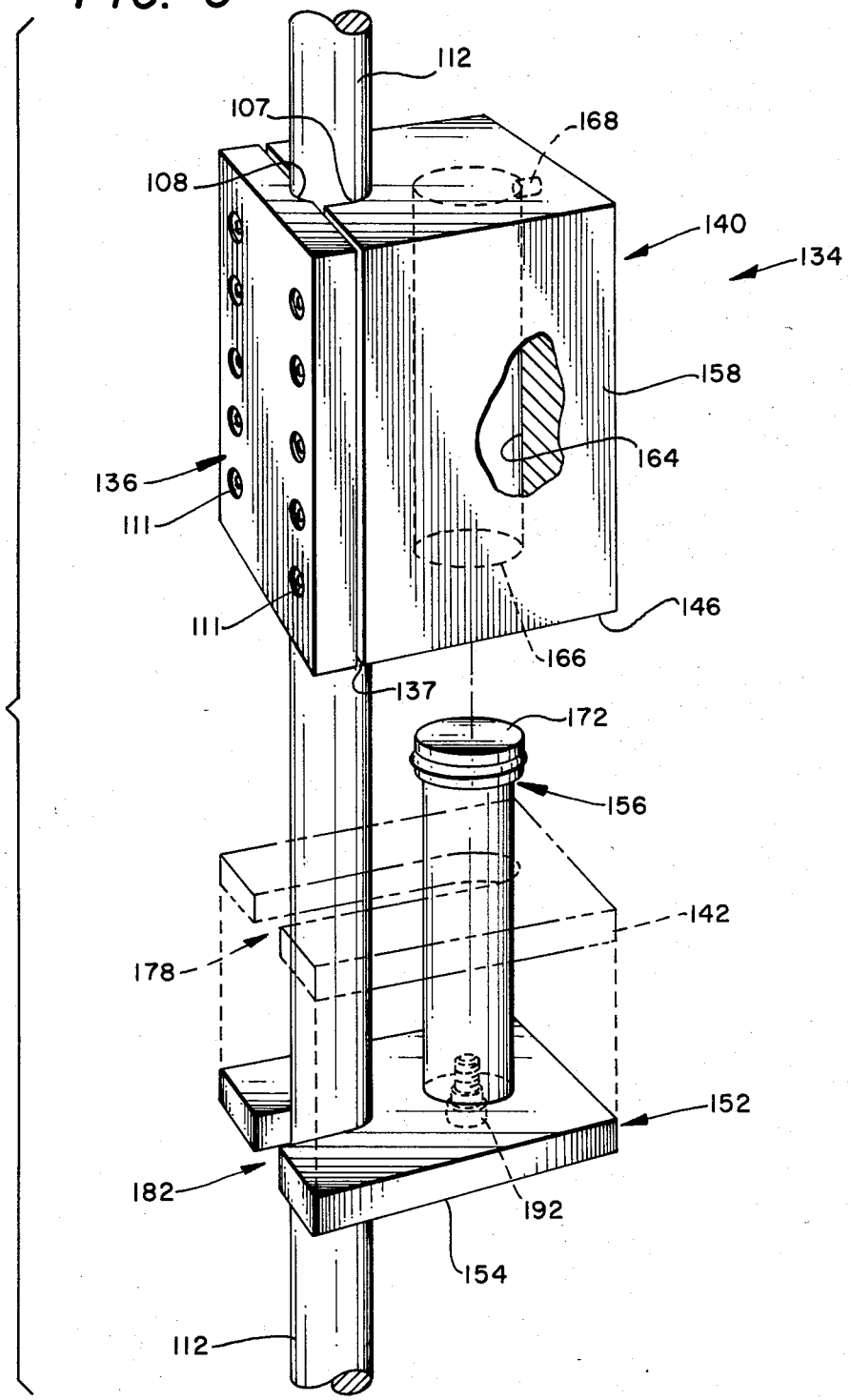

In the alternate embodiment of the invention 134 disclosed in FIG. 6, the hydraulically actuated lifting device 140 includes a main body 158 having a rod clamp 136 attached thereto. Numeral 137 indicates the interface formed between the clamp 136 and the jack main body 158. Bolts 111 affix the plate member of rod clamp 136 to the main body 158 with great pressure. A rod passageway or trough is formed by the illustrated semicircular surfaces 107, 108, which cooperate together to provide an elongated circular passageway having an inside diameter slightly smaller than the outside diameter of the rod 112, so that when the bolts 111 are tightly made up, the rod is captured within the trough with great friction therewithin, thereby eliminating the necessity of a rod clamp such as seen at 36 in FIG. 2.

Cylinder 164 downwardly opens at 166 and is communicated at the upper end thereof at 168 to a source of hydraulic pressure, such as seen at V1, V2, A and P in FIG. 5, for example.

Piston 156 has an upper end 172 reciprocatingly received in sealed relationship within cylindrical counterbore 164, there being but one piston and one cylinder required by the embodiment 134. The lower end of the piston is bolted onto the base plate 152 by means of the fastener 192. The base plate 152 includes an outwardly opening cutout 182 which corresponds to the cutout 82 of FIG. 5.

In operation, hydraulic pressure applied to passageway 168 forces piston 156 to move downwardly within cylinder 164. The lower surface 154 of the base plate 152 bears against the upper surface 44 of hanger bar 38 of FIG. 2, for example; thereby forcing the rod 12 to move vertically upwards respective to the hanger bar 38. This action spaces the polish rod above its normal position of operation, thereby enabling shim pack 142 to be inserted between the lower face 146 of the main body 158 and the upper face of the base plate. The large U-shaped cutout, as noted by numeral 178, provides ample clearance for the piston 156.

A quick disconnect can be connected to passageway 168, and hydraulic pressure applied to the chamber formed by the upper piston surface 172 and the upper cylinder wall 164. The shim pack 142 can be pinned in a manner similar to the shim pack 42 as seen at 84, 84', if desired, thereby precluding relative movement between the shim and the remaining structure.

The present invention provides method and apparatus which eliminates a gas lock condition in a downhole pump, and alternatively eliminates debris from proximity of a valve device associated with the reciprocating downhole production pump, wherein the pump is actuated by a rod string or the like. The present invention has the unexpected advantage of enabling the downhole pump to be bumped from the surface of the earth. The bumping action can be closely controlled in a manner which heretofore has not been possible using prior art expedients. The close control of the bumping action achieves the removal of the gas or debris in a more desirable manner than heretofore has been available to those skilled in the art. The positive control of the spaced relative position between the pump barrel and pump piston can be adjusted during the operation of the pumpjack unit to enable the magnitude of the impact force to be carefully controlled during the gas or debris removal step.

The present invention enables a single technician to visit the various well sites, study the pumping characteristics of the various pumping units, determine the efficiency of operation, and thereby conclude the necessity for bumping the well. When the technician concludes that the well requires bumping, the bumping method set forth herein can be carried out by a single technician by the employment of the present apparatus.

I claim:

1. In a pumpjack unit having a rod string supported by a polish rod which in turn is supported by a reciprocating mechanism, wherein the rod string extends downhole in a wellbore to a downhole pump having a pump piston reciprocatingly received within a pump barrel, with the downhole pump piston including a traveling valve assembly associated therewith, and the pump barrel having a stationary valve assembly associated therewith; the improvement comprising:

a jack means by which the rod string can be supported by the reciprocating mechanism; said jack means has a main body within which there is formed a cylinder, a piston reciprocatingly received within said cylinder and forming a variable chamber on one side of said piston; flow passageway means by which fluid flows into and out of said variable chamber to cause the piston to move respective to the main body;

said main body includes an elongated trough which outwardly opens and receives the polish rod therein; a plate member having a confronting surface affixed to said main body to capture the polish rod therebetween and thereby forms a polish rod clamp; a jack base plate affixed to the free end of the piston and supported by structure which reciprocates said rod string; wherein actuation of said jack means moves said polish rod clamp means and said base plate apart; and shim means removably received between said main body and said base plate for changing the relative position of the pump piston respective to the pump barrel;

so that the jack means can be actuated into a first position until the pump piston structure impacts against the pump barrel structure with sufficient force to dislodge any debris which may be lodged in a valve of the pump, and thereafter the jack means can be actuated into a second position, so that the pump piston reciprocates and produces fluid from the wellbore.

2. The improvement of claim 1 wherein said shim means includes a plurality of spacer members and are provided to enable the magnitude of the impact to be controlled during the pumping operation by adjusting the relative position of the main body and the base plate.

3. The improvement of claim 1 wherein said base plate has a cut-out which is axially aligned with said elongated trough through which the polish rod is received, said trough is formed jointly through both the main body and the plate member for receiving a polish rod therethrough, conduit means connected to said cylinder, and a source of fluid pressure connected to the conduit means so that pressure can be effected to move the piston means while the pumpjack unit is reciprocating the downhole pump.

4. The improvement of claim 1 wherein said base plate is supported on a hanger bar; and the rod clamp trough is formed perpendicular respective to the base plate; said shim means including spacer means captured between the hanger bar and the main body to thereby enable the spacer means to be removed and the magnitude of the impact to be controlled by actuating the piston during the pumping operation.

5. In a pumpjack unit having a rod string supported by a reciprocating bridle mechanism, which includes a hanger bar, wherein the rod string extends downhole in a wellbore to a downhole pump having a pump reciprocatingly received within a pump barrel, with the downhole pump including a traveling valve assembly associated with the piston thereof, and the pump barrel having a stationary valve assembly in fluid communication therewith, the combination with said pumpjack unit of a jack apparatus by which debris from one of the valve assemblies can be removed and gas lock can be eliminated; said jack apparatus comprising:

a main housing, a plate member removably affixed to said main housing; a rod clamp means including a first semi-circular rod receiving cavity formed along one face of the plate member, and a second semi-circular rod receiving cavity formed along one face of the main housing, said first and second semi-circular cavities cooperate together to form a cylindrical bore to thereby clamp the rod string therein when said plate member is affixed to said main housing with great force;

a cylinder formed within said main housing in parallel and spaced relationship respective to the rod receiving cavity; a piston reciprocatingly received within said cylinder, a variable chamber formed between one end of the piston and the cylinder, flow passageway means by which a source of fluid pressure can be connected to the variable chamber and reciprocate the piston within the cylinder;

means on the free end of said piston for engaging the hanger bar in such a manner that when fluid pressure is effected within the variable chamber, the main housing is forced to move vertically upwards, thereby lifting the polish rod respective to the hanger bar; and means including a shim pack for insertion between the hanger bar and main housing by which the relative position of the pump piston and pump barrel can be adjustably fixed when the pressure is released from the variable chamber; whereby the relative position of the pump piston and pump barrel can be adjusted by controlling the fluid pressure contained within the variable chamber.

6. The combination of claim 5 wherein said cylindrical bore formed by said first and second semi-circular cavities extend along the entire length of said plate member and said main housing;

a jack base plate attached to the free end of said piston, said jack base plate bears against the hanger bar; whereby fluid pressure effected within the variable chamber forces the jack base plate and the rod clamp means to move apart thereby moving the rod string vertically upwards respective to the hanger bar.

* * * * *

UNITED STATES PATENT AND TRADEMARK OFFICE

CERTIFICATE OF CORRECTION

PATENT NO. : 4,498,845

DATED : February 12, 1985

INVENTOR(S) : HOMER F. PITTMAN and BOBBY D. GAGE

It is certified that error appears in the above-identified patent and that said Letters Patent is hereby corrected as shown below:

Column 3, line 4, correct the spelling of "upwardly";

Column 8, line 36, delete "means" after clamp;

Column 9, line 7, insert --piston-- before "recipro-".

Signed and Sealed this

*Twenty-fifth* Day of *June 1985*

[SEAL]

*Attest:*

DONALD J. QUIGG

*Attesting Officer* *Acting Commissioner of Patents and Trademarks*